US005431345A

United States Patent [19]

Lund et al.

[11] Patent Number: 5,431,345

[45] Date of Patent: Jul. 11, 1995

[54] FOAM DISPENSING SYSTEM FOR A FOAMABLE LIQUID

[75] Inventors: Mark T. Lund, West Chester; Dimitris I. Collias, Cincinnati, both of Ohio

[73] Assignee: The Procter & Gamble Company, Cincinnati, Ohio

[21] Appl. No.: 250,979

[22] Filed: May 31, 1994

Related U.S. Application Data

[63] Continuation-in-part of Ser. No. 152,995, Nov. 12, 1993, abandoned.

[51] Int. Cl.[6] ..... B05B 1/14

[52] U.S. Cl. ..... 239/329; 239/343; 239/590.3; 239/DIG. 23

[58] Field of Search ..... 239/330, 343, 590.3, 239/590, 553.5, 332, 329, DIG. 23, 575

[56] References Cited

U.S. PATENT DOCUMENTS

| | | | |
|---|---|---|---|
| 2,624,622 | 1/1953 | Holte | 239/343 |
| 2,645,292 | 7/1953 | Williams | 169/15 |
| 3,946,947 | 3/1976 | Schneider | 239/401 |
| 4,153,201 | 5/1979 | Tada | 239/333 |
| 4,230,277 | 10/1980 | Tada | 239/333 |
| 4,350,298 | 9/1982 | Tada | 239/333 |
| 4,558,821 | 12/1985 | Tada et al. | 239/333 |
| 4,603,812 | 8/1986 | Stoesser et al. | 239/329 |
| 4,606,480 | 8/1986 | Gazulla | 222/341 |
| 4,646,973 | 3/1987 | Focaracci | 239/428.5 |
| 4,720,046 | 1/1988 | Morane | 239/343 |
| 4,730,775 | 3/1988 | Maas | 239/120 |
| 4,767,060 | 8/1988 | Shay et al. | 239/401 |
| 4,779,803 | 10/1988 | Corsette | 239/428.5 |
| 4,815,663 | 3/1989 | Tada | 239/333 |
| 4,921,170 | 5/1990 | Grollier | 239/343 X |
| 4,925,106 | 5/1990 | Maas et al. | 239/333 |
| 4,958,754 | 9/1990 | Dennis | 222/383 |
| 5,061,393 | 10/1991 | Linares et al. | 252/143 |
| 5,064,103 | 11/1991 | Bennett | 239/343 |
| 5,156,307 | 10/1992 | Callahan et al. | 222/189 |
| 5,158,233 | 10/1992 | Poster et al. | 239/333 |
| 5,294,025 | 3/1994 | Foster | 222/383 |
| 5,344,053 | 9/1994 | Foster et al. | 222/383 |
| 5,364,031 | 11/1994 | Taniguchi et al. | 239/330 |
| 5,373,991 | 12/1994 | Nelson | 239/333 |
| 5,385,302 | 1/1995 | Foster et al. | 239/333 |

FOREIGN PATENT DOCUMENTS

| | | | |
|---|---|---|---|
| 0619240A2 | 10/1994 | European Pat. Off. | B65D 47/34 |
| 2927765 | 2/1981 | Germany | 239/590.3 |
| 1-110863 | 7/1989 | Japan . | |
| 2024044 | 1/1980 | United Kingdom | 239/343 |
| 2024049 | 1/1980 | United Kingdom | 239/343 |

*Primary Examiner*—Andres Kashnikow
*Assistant Examiner*—Kevin Weldon
*Attorney, Agent, or Firm*—John M. Howell; Michael E. Hilton; Ronald W. Kock

[57] ABSTRACT

A foam dispensing system for a foamable liquid has a means for producing a spray of droplets in which the spray of droplets has key parameters of: the number averaged mean diameter and the mean axial droplet velocity. The foam dispensing system also has a foaming nozzle connected to the means for producing a spray of droplets that is placed in fluid communication with the spray of droplets. The foaming nozzle has a screen which has a plurality of screen openings having a mesh range from 30 to 60 openings per linear inch. Key parameters of the screen are: the percent open area is from about 35% to 60% and the screen openings are larger than the number average mean diameter of the spray of droplets. When the mean axial droplet velocity is at least 8 m/s, the spray of droplets is transformed into a foamed spray as the droplets pass through the plurality of screen openings.

17 Claims, 4 Drawing Sheets

FOAM DISPENSING SYSTEM FOR A FOAMABLE LIQUID

CROSS-REFERENCE TO RELATED APPLICATION

This is a continuation-in-part of my prior application, Ser. No. 08/152,995, entitled Foam Dispensing System Utilizing an Optimized Percent Open Area Screen to Foam a Spray, filed on Nov. 12, 1993, which is abandoned.

FIELD OF THE INVENTION

The present invention pertains to a foam dispensing system that transforms spray droplets into a foamed spray via a foaming nozzle.

BACKGROUND OF THE INVENTION

Many consumer product packages known in the art utilize manually-actuated pump sprayers to effectively atomize and evenly disperse products. U.S. Pat. No. 4,958,754, issued Sep. 25, 1990 to Dennis discloses such a package for use with products such as window cleaners, hair sprays, insect poisons, carpet cleaners, automotive cleaners, and the like. Although such pump sprayers are very effective at distributing a bulk liquid over a large coverage pattern area, some applications are unsuitable for spray delivery. For example, when a product is applied in a confined area such as a shower stall, fine spray droplets may be inadvertently inhaled by the user creating potential health problems including damage to the respiratory system.

The pump sprayer industry has responded to these health concerns by designing foaming nozzles that effectively aerate spray droplets to form a foamed spray having a minimal number of unwanted fine spray particles. These foamed sprays comprise large foamed particles having a plurality of bubbles which not only reduce health risks, but, have performance benefits. The performance benefits include improved visibility of the foamed product on the surface to be cleaned, visually signaling the consumer the area is adequately covered by the product. Furthermore, in context of cleaning products, the presence of foam provides the consumer with a perception that cleaning is taking place. Finally, foamed sprays provide improved cling to vertical surfaces avoiding product run off as is experienced with most liquid sprays.

Despite the advantages foamed sprays have over liquid sprays, consumers continue to demand improvements for foamed sprays. For example, consumers prefer that foamed sprays have a wide and uniform coverage pattern to minimize the number of pump strokes required to cover a targeted surface. Consumers also prefer that the foamed sprays exhibit better cling to the vertical surfaces they are applied to, thereby facilitating neater and more efficient use of the product. In context of a cleaning product, good cling to a non-horizontal surface increases the products residence time on the dirty surface to facilitate the breakdown of dirt and grime and its subsequent removal from the surface.

Consumers also desire foam dispensing systems requiring only minimal force and work to dispense. Foam dispensing systems are not preferred by consumers if they require significant effort to actuate, or where multiple strokes are required to cover large surfaces. This effort becomes especially difficult and cumbersome for those having arthritic finger and hand joints. Generally, foam dispensing systems should not require the fluid to travel through tortuous paths resulting in significant consumer effort to dispense the product. Finally, it is desirable that foamed sprays be delivered without experiencing undue messiness. Many foam dispensing systems known in the art do not provide sufficient momentum to the foamed particles so that they reach the targeted surface. This results in foamed sprays depositing on non-targeted surfaces as well dripping on the consumer.

The prior art discloses devices designed for the production of foamed sprays. Such devices apply techniques for mixing air with liquid spray droplets to create a foamed spray. For example, there is a large body of patent literature related to highly mechanized and automated devices for the production of large volumes of foam for fire extinguishing purposes. The foam utilized in this prior art, however, consists of discrete bubbles in a continuous air phase and is commonly characterized by the term "fog" foam. U.S. Pat. No. 2,645,292, issued Jul. 14, 1953 to William's, discloses fog foams produced by passing the fire extinguishing fluid through a screen in order to create a cloud of bubbles. However, such a cloud or fog foam disclosed therein is unsuitable for most consumer products for the reasons mentioned above regarding health problems and usage efficiency.

The art discloses foam dispensing systems better suited for consumer products than mentioned above. Such systems include manually-actuated pump sprayer as disclosed in U.S. Pat. No. 3,946,947, issued Mar. 30, 1976 to Schneider. In one embodiment disclosed by Schneider, the foaming nozzle features a restriction in the form of a venturi located downstream of the spray discharge orifice of a pump sprayer. Said venturi reduces the air pressure surrounding the spray droplets and allows ambient air to be sucked into the venturi via a plurality of air passages in the foaming nozzle of the sprayer located upstream of the venturi. The inclusion of air causes aeration of the liquid spray droplets just before they impinge on the convergent portion of said venturi resulting in turbulence of the liquid and air mixture, therein forming a foamed spray. The venturi has an optimum length to control the degree of mixing of the air and liquid in order to form highly mixed foamed sprays.

Although the foamed spray produced by the above-mentioned system generally has good quality, the spray angle of the discharged foam is substantially interrupted by the above-mentioned restriction in the foaming nozzle. This results in the foamed spray having a narrow spray pattern which requires multiple pump strokes to adequately cover a surface. In addition, the narrow pattern concentrates the foam over a smaller area thereby encouraging product run-off. Furthermore, the disclosed system has a long foaming nozzle, requiring added work to pump the sprayer to overcome the resistance to the flow of product through the foaming nozzle. Said foaming nozzle is also responsible for engineering complexity and added material cost as compared to typical nozzles.

More recently, other improved means for producing turbulence by impingement of the liquid spray have been developed. These means include forcing the liquid spray to impinge on the inner surface of a cylindrically shaped wall of a foaming nozzle. Exemplary dispensing systems featuring such designs, as well as additional features such as on/off positions or liquid spray/foamed spray positions to foaming nozzles are disclosed in U.S.

Pat. No. 4,767,060, issued Aug. 30, 1988 to Shay et al.; U.S. Pat. No. 4,779,803, issued Oct. 25, 1988 to Corsette; and U.S. Pat. No. 5,158,233, issued Oct. 27, 1992 to Foster et al. Although these systems have overcome the disadvantageous engineering complexity and material cost as previously mentioned, the spray angle is still sufficiently interrupted, producing narrow foamed spray patterns and the problems associated with such patterns as mentioned above.

Other systems disclosed in the art utilize spray impinging obstacle walls positioned directly in the path of the liquid spray to produce a foamed spray. U.S. Pat. No. 4,350,298, issued on Sep. 21, 1982 to Tada discloses a pump sprayer including a foaming nozzle having an outlet wall extending across the entire cross sectional area of the nozzle. This wall is comprised of a plurality of arms radially extending from the center of the wall. Liquid spray droplets collide with the arms in the presence of ambient air in the foaming nozzle to create a foamed spray. Said foamed spray exits the foaming nozzle through openings between the radial arms of the outlet wall.

In another example, U.S. Pat. No. 4,925,106, issued May 15, 1990 to Maas et al. discloses a perforated wall placed downstream of the spray discharge orifice, whereby a divergent spray impinges with said wall and is randomly deflected, mixing with air in the foam chamber to create a foam. Other similar foam forming obstruction devices are disclosed in U.S. Pat. No. 4,646,973, issued Mar. 3, 1987 to Focaracci and U.S. Pat. No. 4,730,775, issued Mar. 15, 1988 to Maas. Although such systems successfully transform spray droplets into foamed sprays, the resultant coverage pattern is inadequate for many applications, since the spray is being substantially interrupted and redirected.

Foaming nozzles for pump sprayers disclosed in the prior art also utilize screens to transform liquid spray droplets into a foamed spray. U.S. Pat. No. 4,603,812, issued Aug. 5, 1986 to Stoesser et al., discloses a foam dispensing system comprising a screen having a size from about 60 to 200 mesh U.S. Sieve Series, located downstream of a spray discharge orifice, and a means for introducing air into the foaming nozzle. Stoesser' nozzle, having the mesh sizes disclosed therein, produces foamed sprays of high quality with superior cling to a vertical surface, and with a spray pattern that is substantially the same as the spray pattern of droplets absent the foaming nozzle. However, Stoesser's fine mesh screen is susceptible to clogging. Stoesser also discloses that "screens having a smaller mesh size than that indicated will severely reduce spray velocity and cause excessive dribbling, whereas screens having a larger mesh size will permit spray to pass therethrough without sufficient foaming."

Accordingly, it is an object of the present invention to provide a foam dispensing system for a foamable liquid which produces a high quality foamed spray with superior cling to vertical surfaces, and with a spray pattern that is substantially the same as the spray pattern of droplets absent the foaming nozzle, and also which minimizes nozzle screen clogging.

It is also an object of the present invention to provide a foam dispensing system having a less expensive screen to mold or to weave by virtue of using a coarser screen than those having mesh sizes above 60.

SUMMARY OF THE INVENTION

In practicing the present invention, foamed sprays are the result of transforming liquid spray droplets into a high quality foam as the droplets pass through a screen having a particular percent open area located in a foaming nozzle. It is believed that screen mesh size is not a critical factor in the production of a high quality foam, regardless of the liquid sprayed. Instead screen percent open area and spray droplet size relative to screen opening size are critical factors.

Percent open area is distinguished from screen mesh size by the use of different wire diameters. That is, a screen may have a small open area for a given mesh size if the screen wire diameter is coarse (large), or it may have a large open area for the same mesh size if the screen wire diameter is fine (small). Mean diameter of spray droplets approaching the screen should be smaller than each screen opening.

In a preferred embodiment of the present invention, a foam dispensing system for a foamable liquid comprises a means for producing a spray of droplets and a foaming nozzle. The spray of droplets has a number averaged mean diameter and a mean axial droplet velocity greater than about 8 m/s. The foaming nozzle is connected to the means for producing the spray of droplets and is placed in fluid communication with the spray of droplets. The foaming nozzle comprises a screen having a plurality of screen openings. Each of the screen openings is larger than the number averaged mean diameter of the spray of droplets. The screen has a percent open area from about 35% to 60%, so that the spray of droplets is transformed into a foamed spray as the spray of droplets passes through the plurality of screen openings.

Also in this embodiment the foaming nozzle is connected to the means for producing a spray of droplets such that an enclosed space is provided between the means and the screen, open only at the screen. The spray of droplets has an overall pattern dimension at the screen. The screen may have a dimension approximately equal to the overall diameter of the spray of droplets at the screen so that any air entering the space enters through the screen inside the overall pattern dimension of said spray of droplets. The foaming nozzle has a screen that has a mesh range from 30–60 openings per linear inch.

In this embodiment the spray of droplets passes through the screen openings such that a majority of droplets foam upon contact with the liquid bridges across screen openings. The means for producing a spray of droplets is preferably a manually-actuated pump sprayer placed in fluid communication with and attached to a container of foamable liquid. The said pump sprayer includes a spray discharge orifice having a diameter from about 0.40 mm to 0.80 mm.

DRAWINGS

The present invention will be better understood with reference to the following Detailed Description and to the accompanying Drawing Figures, in which.

DETAILED DESCRIPTION OF THE INVENTION

Figure 1:
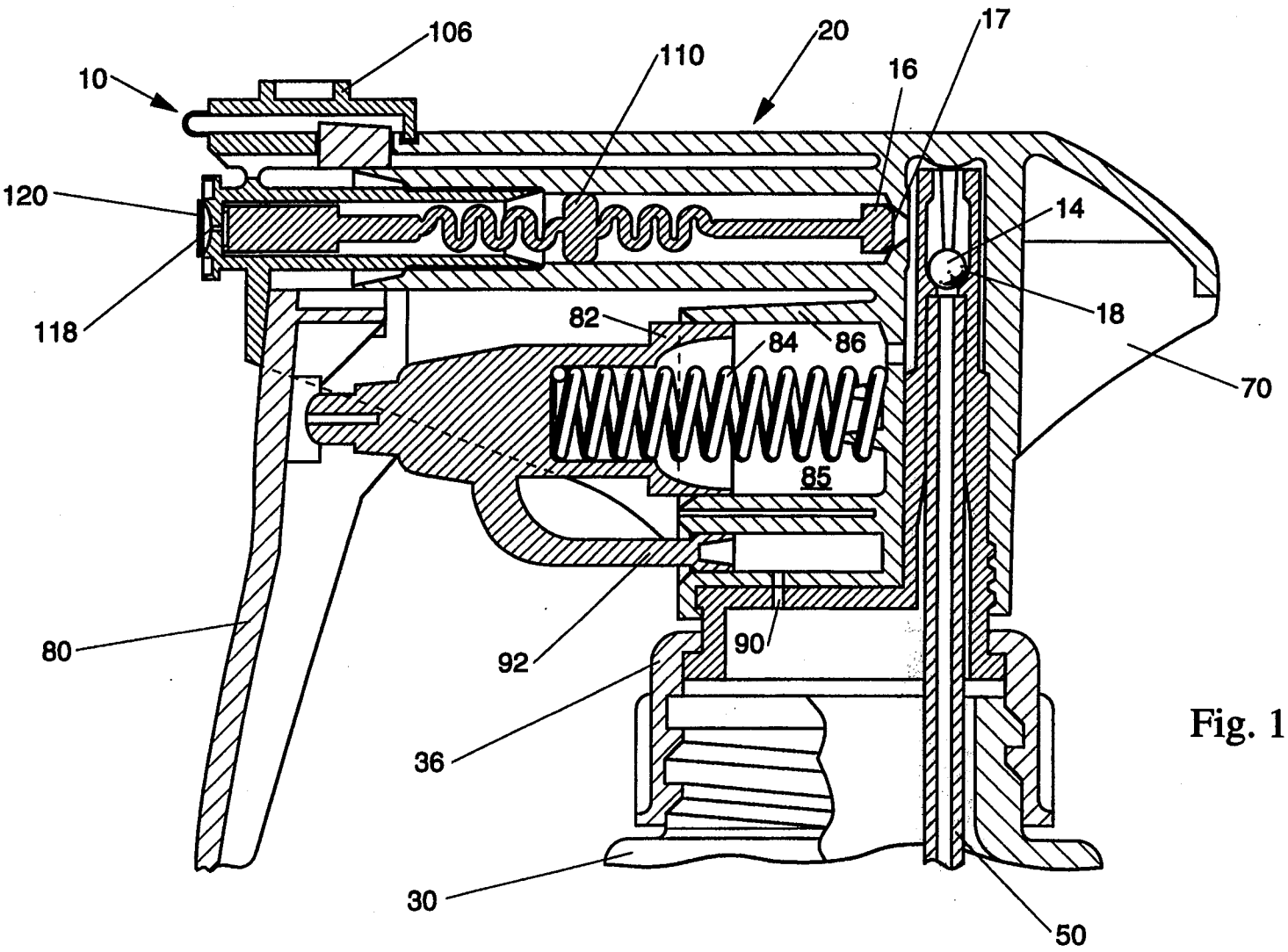
FIG. 1 is a sectional view of the foaming nozzle assembled to a trigger sprayer in the "on" position.
Figure 2:
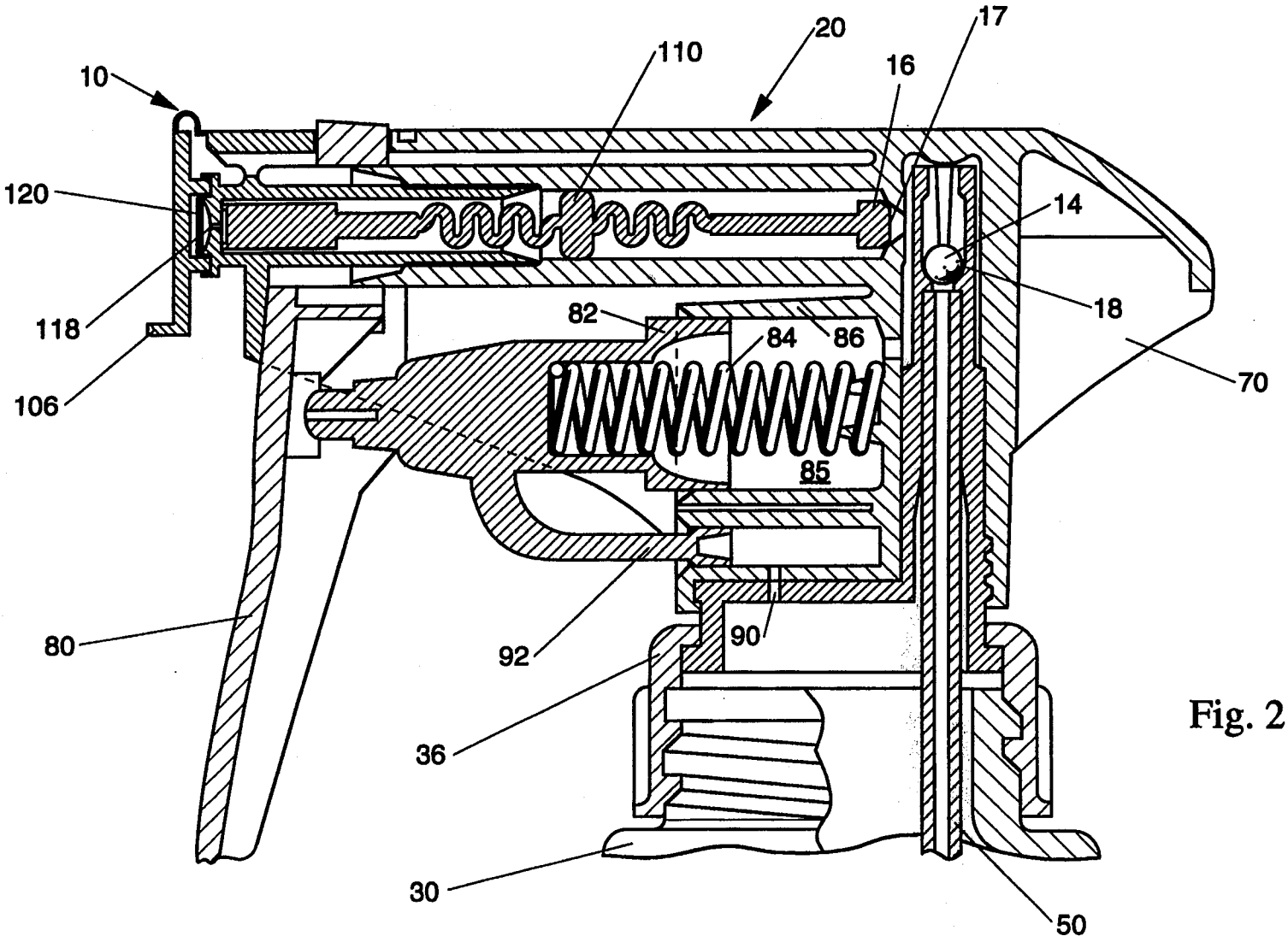
FIG. 2 is a sectional view of the foaming nozzle assembled to a trigger sprayer in the "off" position.

FIGS. 1 and 2 illustrate the foam dispensing system according to the present invention in the "on" and "off" position, respectively. The system includes a foaming nozzle 10 incorporated into a manually-actuated pump sprayer 20 which is attached to a container 30 (only partially shown) preferably by a threaded closure or bayonet mounted closure 36. Pump sprayer 20 includes a dip tube 50, a shroud 70 housing the internal components of pump sprayer 20, a trigger 80, and a spray discharge orifice 118. Dip tube 50 extends downward within container 30 from pump sprayer 20. Trigger 80 serves as a pump actuator, and spray discharge orifice 118 transforms a bulk liquid into a spray. Foaming nozzle 10 comprises a means for selectively turning the nozzle to the "on" or "off" position herein shown as a door 106. The "on" position is set to allow the foamed spray to be discharged, while the "off" position is used for sealing during shipping or when the package is not in use.

While a wide variety of manually-actuated pump sprayer mechanisms are suitable for use in the present invention, the particular trigger sprayer version illustrated in FIGS. 1 and 2 is illustrative of the operating features typical of such pump sprayer mechanisms and is presently a preferred configuration. A more detailed description of the features and components of this pump sprayer may be found in U.S. Pat. No. 4,958,754 issued Sep. 25, 1990 to Dennis; incorporated herein by reference. Pump sprayers of this general type are commercially available versions sold by Continental Sprayers, Inc.

Figure 3:
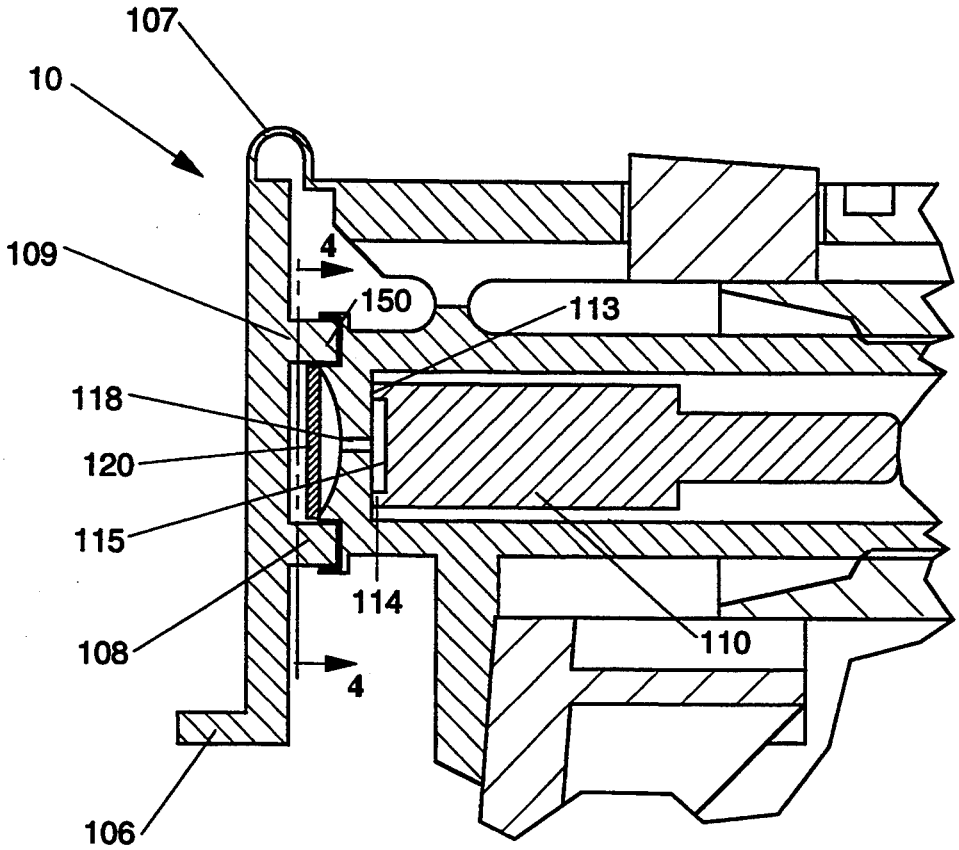
FIG. 3 is an enlarged sectional view of the foaming nozzle and the end portion of the manually-actuated pump sprayer.
Figure 4:
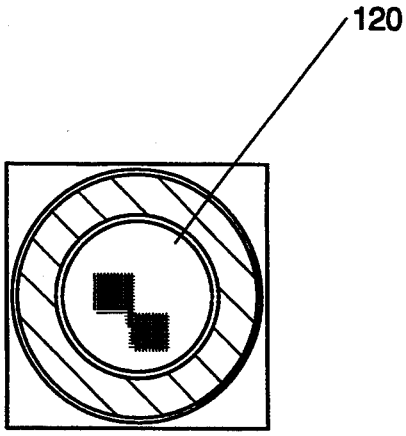
FIG. 4 is an enlarged cross-sectional frontal view of the foaming nozzle.

FIG. 3 is an enlarged sectional view of foaming nozzle 10 and the portion of a swirler 110 terminating at said foaming nozzle. FIG. 4 illustrates an enlarged frontal view of foaming nozzle 10 shown in FIG. 1. Foaming nozzle 10 comprises a screen 120 attached to a surface 150 by means of ultrasonic welding, spot welding, the use of an adhesive, or any other means commonly known in the art. Surface 150 is spaced away from spray orifice 118 by an axial spacer. Such an axial spacer is seen as concave surface 119 of the orifice housing in FIG. 3. In the present invention, at least one screen is required to properly foam the liquid spray, however, multiple screens may be employed to perform the same task. However, for economical and easy manufacturing it is preferred that the foaming nozzle contain a single screen.

The screens used in the present invention consist of a plurality of evenly or unevenly distributed openings of equal or dissimilar size. Said screens, which can be circular, square or of any other shape, can be woven using any fabric-like material such as nylon, polyester, or any metallic materials such as steel. The screens can also be made of molded materials such as polyethylene or polypropylene or any other thermoplastic or thermoset, or can be of the form of a perforated plate having various shaped holes in it. Regardless of the means by which it is made, and the materials it is made of, the screens mentioned above have a plurality of ribs or wires having any cross-sectional shape. These screens or combination of screens can be placed at any angle or orientation with respect to spray discharge orifice 118. In addition, the screens can be conical or arcuate in cross-section protruding away or inward from foaming nozzle 10. Foaming nozzle 10 preferably includes door 106 which is hinged at a living hinge location 107 for opening and closing pump sprayer 20. FIG. 3 illustrates foaming nozzle 10 in the "off" position where the fluid path out of the nozzle is effectively sealed at points 108 and 109. When door 106 is rotated to the "on" position (shown in phantom) the foamed spray can be discharged through said nozzle.

As the operating principles of pump sprayer mechanisms themselves are generally well-known, a brief overview of their operation with respect to the product delivery systems according to the present invention follows. To begin a pump cycle, trigger 80 is rotated to the right and towards container 30 forcing a piston 82 and a secondary piston 92 to move rightwardly thereby pressurizing the pre-primed foamable liquid product in a liquid chamber 85. When the product is pressurized, an inlet ball valve 14 is forced against an inlet ball valve seat 18 to effectively form a seal, and an outlet valve 16 is unseated off an outlet valve seat 17 to form a fluid flow path. This permits the product to flow in a swifter conduit 21 and around swifter 110, exiting a sprayer discharge orifice 118. Spray discharge orifice 118 preferably forms a conical spray, however, any spray pattern comprised of droplets and the means to create such a spray may be used herein. Spray droplets exit spray discharge orifice 118 and impinge on screen 120 to form a foamed spray. When trigger 80 is released, a spring 84 forces piston 82 to return to its original position creating a slight vacuum condition in liquid chamber 85 as outlet valve 16 forms a seal against surface 17. This slight vacuum forces ball inlet valve 14 to unseat allowing product to flow up dip tube 50 to recharge liquid chamber 85 for the next stroke. Bottle venting is accomplished when secondary piston 92 slides beyond a vent hole 90, allowing ambient air to replace the product that has been dispensed from container 30.

Not wishing to be bound by theory, foamed sprays are created in foaming nozzle 10, shown in FIG. 3, in the following manner. Pump sprayer 20 is actuated, allowing liquid product to travel through an annular gap 111, and passing through channels 113 and 114, (not shown), and into spin cup 115 at the end of swifter 110 terminating at a spray discharge orifice 118. The liquid product gains rotational velocity in said spin cup and exits spray discharge orifice 118 as a conical sheet of liquid. Instabilities cause this conical sheet to break up into liquid spray droplets wherein a two-phase system is formed of liquid spray droplets dispersed into air. Initially, the liquid droplets impinge on screen 120, forming liquid bridges in the openings of said screen. The trailing droplets impinge upon these liquid bridges forming small air bubbles as said droplets enter said liquid bridges. As the liquid droplets pass through the liquid bridges, there is a phase inversion wherein the air in the form of the bubbles becomes the dispersed phase in the continuous liquid phase. The liquid droplets are now foamed particles which exit the liquid bridges and form, in the aggregate, the foamed spray. This foamed spray is discharged through said foaming nozzle without substantial change to the original pattern of said liquid spray droplets.

Figure 5:
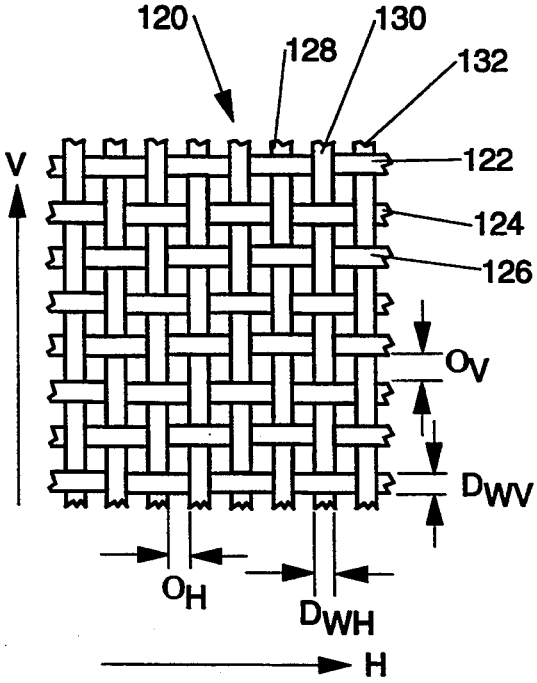
FIG. 5 is an enlarged frontal view of the screen portion of the foaming nozzle.

FIG. 5 is an enlarged frontal view of screen 120 of foaming nozzle 10. Screen 120 comprises ribs or wires 122, 124, 126 in the horizontal direction, H, and ribs or wires 128, 130, 132 in the vertical direction, V, with diameters denoted as $D_{w,H}$ and $D_{w,V}$, respectively. The dimensions of the formed openings in the horizontal and vertical directions are denoted as $O_H$ and $O_V$, respectively. The mesh size, M, is the number of openings per linear 25.4 mm (or 1 inch) counting from the center of any rib to a point exactly 25.4 mm in distance from said point. Therefore, the mesh sizes in the horizontal, $M_H$, and vertical, $M_V$, directions, respectively, are defined as follows:

$$M_H = 1/(O_H + D_{w,H}) \quad (1)$$

$$M_V = 1/(O_V + D_{w,V}) \quad (2)$$

This screen, called a dual-mesh size screen, has a mesh size denoted as $M_H$ by $M_V$.

However, in the most preferred embodiment, the ribs or wires have a circular cross-section in each direction with equally sized diameters $D_w$. The wires or ribs form square openings with the dimension between the vertical and horizontal ribs or wires denoted as O(mm), hereinafter referred to as opening dimension. Since the rib or wire diameters in both directions are the same, the mesh size also is the same in both directions. This screen is known as a square-mesh screen and has a mesh size, M, equal to:

$$M = 1/(O + D_w) \quad (3)$$

Another characteristic of a screen is its percent open area, A, which is defined as 100 times the ratio of the sum of the opening areas to the total screen area. When the wire diameters and opening dimensions in the horizontal and vertical directions are dissimilar, the percent open area is defined as:

$$A = 100 \times [(O_H \times O_V)/[(O_H + D_{w,H}) \times (O_V + D_{w,V})] \quad (4)$$

In the most preferred embodiment of the present invention, the openings of the screen are square, that is, the horizontal dimension of the opening is equal to the vertical dimension of the opening and the diameters of the wires or ribs in both directions are equal. The value of the percent open area, A, is then equal to:

$$A = 100 \times [O/(O + D_w)]^2 \quad (5)$$

It is desirable that dispensing systems require less work to dispense and have neater in-use characteristics, however, it is critical that the foamed spray readily clings to the vertical surface it is applied to. The extent to which the product clings is dependent on a number of factors including, but, not necessarily limited to, the pattern of the foamed spray applied to the vertical surface, the distribution of foam particles in said pattern, the quality of the foamed spray in terms of size and the size distribution of the bubbles, the momentum of the foamed spray, and the viscosity of the liquid product being foamed.

In order to compare the cling of foams produced by dispensing systems having various foaming nozzles, a study was conducted wherein the dispensing systems, all having a common pump sprayer (a manually-actuated T-8500 Continental sprayer) with a fixed actuation rate of 0.083 m/sec (3.25 in/sec) positioned 12.7 mm (0.5 in) from the bottom of the trigger, were equipped with foaming nozzles having different screens of various materials, rib or wire diameters, opening dimensions, mesh sizes, and percent open areas at various locations downstream of a spray discharge orifice. Said discharge orifice generated sprays having a distribution of droplet sizes and velocities.

A vertical target 300 mm (12 inches) by 300 mm (12 inches) made of a thin sheet of plastic was placed at an axial distance of 300 mm (12 inches) from the foaming nozzle. The foam dispensing systems tested were actuated once and the collected weight of product remaining on the surface at one minute was determined. This number was then divided by the original dose of product dispensed to determine the percent product remaining on a vertical surface at one minute. This value measures the tendency of the foamed spray to cling to a vertical surface.

Figure 6:
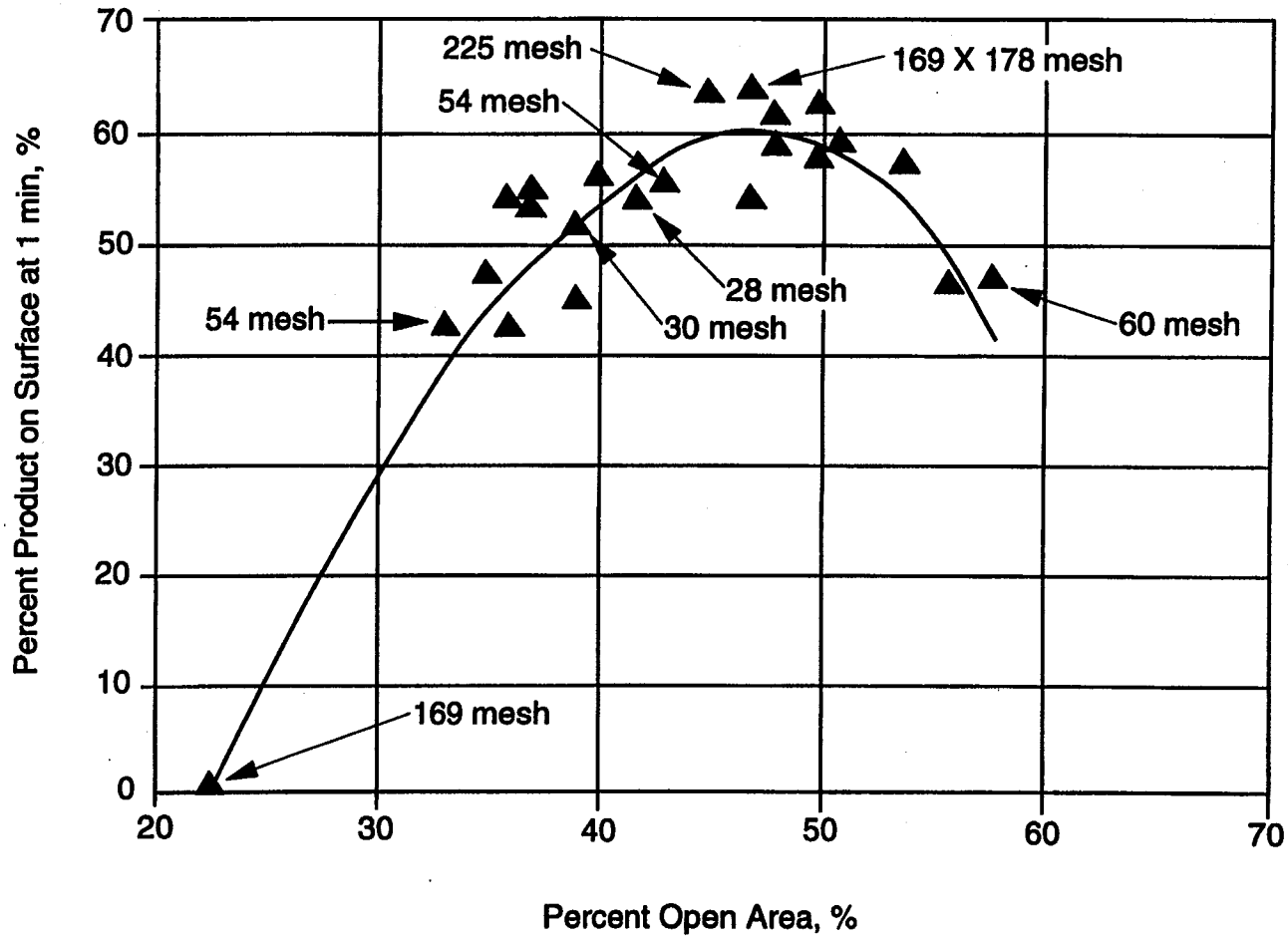
FIG. 6 is a graph illustrating the percent product remaining on a vertical surface at 1 minute as a function of the percent open area of the screen.

FIG. 6 is a graph of the percent product remaining on a vertical surface at one minute as a function of the percent open area of the screen. As shown by the graph, the values for the percent of product on a vertical surface reach a maximum and then begin to decrease, indicating that the screen in the foaming nozzle has an optimum percent open area to produce foamed sprays having good cling. When the data is fitted to a quadratic equation, shown as the line in FIG. 6, the resulting correlation coefficient ($R^2$) is 0.92. Note that a perfect fit to the data would result in a correlation coefficient ($R^2$) of 1.0, whereas an $R^2$ of 0.0 indicates no correlation.

Some specific data points on the graph are accompanied by the mesh size of the screen used. Note that the percent product remaining on a vertical surface is nearly insensitive to the variation of the mesh size of the screen, as indicated by a calculated correlation coefficient of 0.044. In addition, the percent product remaining on a vertical surface is lowest when using a screen having a mesh size of 169, which is most preferred for use by Stoesser et at. FIG. 6 also shows that two screens, both 54 mesh, have significantly different values for the percent product remaining on a vertical surface. The same trend is seen when comparing the screens having a 169 mesh and a nearly identical mesh of 169 by 178. The different percent product remaining is attributable to the percent open area of each screen. Finally, the graph also illustrates that greatest value for the percent product remaining on a vertical surface is attainable with mesh sizes as high as 225 mesh or as low as 30 mesh, provided the percent open area is from 35% to 60%. However, lower mesh number screens are coarser and therefore less susceptible to clogging. Therefore, in order to maximize the percent product remaining on a vertical surface, one must use screens having a percent open area from about 35% to about 60%, preferably from about 40% to about 55%, and most preferably from about 40% to about 46%.

Therefore, it has been discovered that the percent open area of the screen has the most dramatic effect upon the tendency of the foamed spray to cling to a vertical surface, which is at least partly indicative of the quality of the foamed spray. This is surprising based on the teachings in U.S. Pat. No. 4,603,812, issued Aug. 5, 1986 to Stoesser et al., which discloses that there is a specific range of mesh sizes which create an optimum foamed spray. The data presented above shows that the foamed spray made using a dispenser having the mesh sizes disclosed by Stoesser et al. do not correlate well with the tendency of the foamed spray to cling to the vertical surface. In fact, only a minimal correlation between mesh size and percent product remaining on a vertical surface was observed, illustrating a qualitative behavior in the exact opposite direction as disclosed by Stoesser et al. This second correlation, albeit a weak correlation, was found illustrating that screens having a large mesh size severely reduce the mean axial droplet velocities and cause excessive dripping, whereas screens having a small mesh size permit the spray to pass through without sufficient foaming.

Not wishing to be bound by theory, it is believed that a liquid bridge is formed in every opening of the screen with a neck thickness at the center of the opening that depends on the dimensions of the screen, the physical properties of the foamable liquid, and the material of the screen. For a given system of foamable liquid and material of the screen, the percent open area of the screen relates to the neck thickness of the bridge. The foamed particles are generated upon effective collisions of the spray droplets onto the liquid bridges. In general, two conditions should be met for these collisions to be effective in foam generation. The first condition is that the spray droplet mean diameter should be less than the screen opening dimension, while the spray droplet velocities should exceed a threshold level. The second condition is that the neck thickness of the bridge should be greater than a lower limit, below which the liquid droplets penetrate the liquid bridge without forming any air bubbles, therein exiting the bridge as liquid droplets. Furthermore, there is an upper limit of the neck thickness of the liquid bridge, above which the spray droplets lose their momentum as they move through the liquid bridge, exiting the bridge as foamed particles having insufficient momentum to reach the target surface. Therefore, the percent open area of the screen determines whether the neck thickness of the liquid bridge facilitates transformation of spray droplets into a high quality foamed spray having the momentum and coverage pattern comparable to the original spray in order to allow the foamed spray to reach distant targets with a wide coverage pattern.

It has also been discovered that screens having the percent open area disclosed above, particularly those having from about 40% to about 55%, produce foamed sprays having a coverage pattern area and uniformity equal to that of the liquid spray produced by the pump sprayer absent a screen. A large coverage pattern area is an important attribute in minimizing the number of strokes needed to cover a surface. As previously disclosed, a threshold mean axial droplet velocity (based on number of particles) of the spray must be obtained in order to attain desirable foamed spray characteristics. If the mean axial droplet velocity is too low, a sufficient number of bubbles is not generated upon impingement on the liquid bridges. The mean axial droplet velocity should be greater than about 8 m/s, preferably from about 14 m/s to about 25 m/s, and most preferably from about 16 m/s to about 18 m/s just upstream of the screen closest to the pump sprayer. The axial distance between the spray discharge orifice and the screen closest to the pump sprayer necessary to achieve the droplet velocity for the preferred pump sprayer disclosed above is from about 0.5 mm to about 4.0 mm, preferably from about 2.5 mm to about 3.5 mm, and most preferably from about 2.9 mm to about 3.1 mm.

The droplets making up the spray are generated by using a pump sprayer having a discharge orifice having a diameter from about 0.25 mm to about 1.10 mm, preferably from about 0.40 mm to about 0.80 mm, and most preferably from about 0.60 mm to about 0.62 mm wherein the majority (about 90% of the spray droplets) of the droplets produced by said pump sprayers has a diameter from about 0.01 mm to about 0.15 mm, preferably from about 0.02 mm to about 0.12 mm, and most preferably from about 0.02 mm to about 0.08 mm. The mean droplet diameter, however, can easily be changed by changing the spray discharge orifice (diameter and/or length) or the swirler geometry of the pump sprayer.

The majority (about 90%) of the openings of the screen closest to the pump sprayer is larger than the number averaged mean diameter of the droplets. Therefore, regardless of the shape of the openings comprising said screen, said openings are of such a size that they have an opening area equivalent to a square opening dimension from about 0.15 mm to about 0.50 mm, preferably from about 0.25 mm to about 0.35 mm, and most preferably from about 0.29 mm to about 0.32 mm.

Contrary to the teaching in the art, it has been discovered that effective foaming can be achieved when using screens having a diameter nearly identical as the diameter of the spray just upstream from the screen absent a means for inducing air upstream of the screen. Therefore, in the present invention, the screen may be of any shape which has a total area equivalent to that of a circular screen having a diameter greater than or equal to the diameter of the liquid spray in the axial position of the screen. In the present invention the diameter of this circular screen is from about 2.5 mm to about 10.0 mm, preferably from about 3.0 mm to about 5.0 mm, and most preferably from about 3.5 mm to about 4.5 mm.

The following illustrates the most preferred embodiment of the present invention. The foaming nozzle has a screen placed at an axial distance from about 2.9 mm to about 3.1 mm from the spray discharge orifice which has a diameter from about 0.60 mm to about 0.62 mm. The screen employed has a percent open area from about 40% to about 46%, square opening dimension from about 0.29 mm to about 0.54 mm, and a circular screen having a diameter from about 3.5 mm to about 4.5 mm. These dimensional ranges result in a screen mesh form about 30 to 60 openings per linear inch. The mean axial droplet velocity is from about 16 m/s to about 18 m/s just upstream of the screen, while the spray droplet mean diameter (number averaged) is from about 0.02 mm to about 0.08 mm just upstream of the screen.

While the improved foam dispensing system according to the present invention may be utilized with virtually any foamable liquid product, the system has been found to be particularly advantageous for use as a bathroom cleaner, where it may be utilized to clean tubs, tile, shower walls, shower doors, and sinks. These foamable liquid products are often formulated with cleaning agents comprising a mixture of non-ionic and zwitterionic detergent surfactants; hydrophobic cleaning solvent; and polycarboxylate detergent builder. A more detailed description of the preferred formulation components may be found in U.S. Pat. No. 5,061,393 issued Oct. 29, 1991 to Linares et al.; herein incorporated by reference.

A variety of products that are particularly suitable for foaming could also be employed in the foam dispensing system according to the present invention. Such liquid products include, but are not limited to liquid soaps, laundry detergents, dish washing detergents, pretreaters, hard surface cleaners, polishes, carpet cleaners, window cleaners, rust preventatives, and surface coatings of all varieties.

While particular embodiments of the present invention have been illustrated and described, it would be obvious to those skilled in the art that various changes and modification can be made without departing form the spirit and scope of the present invention. For example, additional features such as precompression can be added to the trigger sprayer to guarantee a foam performance regardless of the authority at which the pump sprayer is actuated.

What is claimed is:

1. A foam dispensing system for a foamable liquid, said foam dispensing system comprising:

a) means for producing a spray of droplets, said spray of droplets having a number averaged mean diameter and a mean axial droplet velocity greater than about 8 m/s;

b) a foaming nozzle connected to said means for producing said spray of droplets, said foaming nozzle placed in fluid communication with said spray of droplets, said foaming nozzle including an axial spacer and a screen, said screen having a plurality of screen openings, each of said screen openings being larger than said number averaged mean diameter of said spray of droplets, and said screen having a percent open area from about 35% to 60%, so that said spray of droplets is transformed into a foamed spray as said spray of droplets passes through said plurality of screen openings and mixes with ambient air.

2. The foam dispensing system of claim 1 wherein said axial spacer of said foaming nozzle connected to said means for producing a spray of droplets provides an enclosed space between said means and said screen, open only at said screen, said spray of droplets having an overall pattern dimension at said screen, and said screen having a dimension approximately equal to said overall pattern dimension of said spray of droplets, so that any air entering said space enters through said screen inside said overall pattern dimension of said spray of droplets.

3. The foam dispensing system of claim 1 wherein said screen of said foaming nozzle has a mesh range from 30–60 openings per inch.

4. The foam dispensing system of claim 1 wherein said spray of droplets passes through said screen openings such that a majority of droplets foam upon contact with liquid bridges across said screen openings.

5. The foam dispensing system of claim 1 wherein said means for producing a spray of droplets is a manually-actuated pump sprayer placed in fluid communication with and attached to a container of foamable liquid.

6. A foam dispensing system for a foamable liquid, said foam dispensing system comprising:

a) means for producing a spray of droplets, said spray of droplets having a number averaged mean diameter from 0.02 mm to 0.05 mm and a mean axial droplet velocity greater than about 14 m/s;

b) a foaming nozzle connected to said means for producing said spray of droplets, said foaming nozzle placed in fluid communication with said spray of droplets, said foaming nozzle including an axial spacer and a screen, said screen having a plurality of screen openings, each of said screen openings being larger than said number averaged mean diameter of said spray of droplets, and said screen having a percent open area from about 35% to 60%, so that said spray of droplets is transformed into a foamed spray as said spray of droplets passes through said plurality of screen openings and mixes with ambient air.

7. The foam dispensing system of claim 6 wherein said axial spacer of said foaming nozzle connected to said means for producing a spray of droplets provides an enclosed space between said means and said screen, open only at said screen, said spray of droplets having an overall pattern dimension at said screen, and said screen having a dimension approximately equal to said overall pattern dimension of said spray of droplets, so that any air entering said space enters through said screen inside said overall pattern dimension of said spray of droplets.

8. The foam dispensing system of claim 6 wherein said screen has a mesh size range from 30–60 openings per linear inch.

9. The foam dispensing system of claim 6 wherein said spray of droplets passes through said screen openings such that a majority of droplets foam upon contact with liquid bridges across said screen openings.

10. The foam dispensing system of claim 6 wherein said means for producing a spray of droplets is a manually-actuated pump sprayer placed in fluid communication with and attached to a container of foamable liquid, said pump sprayer including a spray discharge orifice having a diameter from about 0.40 mm to 0.80 mm.

11. A foam dispensing system for a foamable liquid, said foam dispensing system comprising:

a) means for producing a spray of droplets, said spray of droplets having a number averaged mean diameter from 0.02 mm to 0.05 mm and a mean axial droplet velocity from about 16 m/s to 18 m/s;

b) a foaming nozzle connected to said means for producing said spray of droplets, said foaming nozzle placed in fluid communication with said spray of droplets, said foaming nozzle including an axial spacer and a screen ranging in mesh size from 30 to 60 openings per linear inch, said screen having a plurality of screen openings, each of said screen openings being square and having a side dimension ranging from 0.29 mm to 0.54 mm, said screen having a percent open area from about 40% to 46%, so that said spray of droplets is transformed into a foamed spray as said spray of droplets passes through said plurality of screen openings and mix with ambient air.

12. The foam dispensing system of claim 11 wherein said axial spacer of said foaming nozzle connected to said means for producing a spray of droplets provides an enclosed space between said means and said screen, open only at said screen, said spray of droplets having an overall pattern diameter from about 3.5 mm to 4.5 mm at said screen, and said screen having a diameter approximately equal to said overall pattern diameter of said spray of droplets, so that any air entering said space enters through said screen inside said overall pattern diameter of said spray of droplets.

13. The foam dispensing system of claim 9 wherein said spray of droplets passes through said screen openings such that a majority of droplets foam upon contact with liquid bridges across said screen openings.

14. The foam dispensing system of claim 9 wherein said means for producing a spray of droplets is a manually-actuated pump sprayer placed in fluid communication with and attached to a container of foamable liquid, said pump sprayer comprising a spray discharge orifice having a diameter from about 0.60 mm to 0.62 mm.

15. The foam dispensing system for a foamable liquid of claim 1 further comprising a hinged door which seals a fluid path out of said foaming nozzle when in an off position and allows said foamed spray to be discharged from said foaming nozzle when in an on position.

16. The foam dispensing system for a foamable liquid of claim 6 further comprising a hinged door which seals a fluid path out of said foaming nozzle when in an off position and allows said foamed spray to be discharged from said foaming nozzle when in an on position.

17. The foam dispensing system for a foamable liquid of claim 11 further comprising a hinged door which seals a fluid path out of said foaming nozzle when in an off position and allows said foamed spray to be discharged from said foaming nozzle when in an on position.

* * * * *